US006109290A

United States Patent [19]

Sabatinelli

[11] Patent Number: 6,109,290

[45] Date of Patent: Aug. 29, 2000

[54] FUEL DISPENSING SYSTEM

[76] Inventor: Arthur A. Sabatinelli, 1880 Monte Carlo Way, Coral Springs, Fla. 33071

[21] Appl. No.: 09/237,149

[22] Filed: Jan. 25, 1999

[51] Int. Cl.[7] ..... B67D 5/40

[52] U.S. Cl. ..... 137/234.6; 137/376; 222/383.1; 52/126.6

[58] Field of Search ..... 137/234.6, 376; 222/383.1, 372; 52/126.1, 126.5, 126.6

[56] References Cited

U.S. PATENT DOCUMENTS

| | | | |
|---|---|---|---|
| 2,182,126 | 12/1939 | Hogarth . | |
| 2,959,826 | 11/1960 | Larsen et al. | 137/234.6 X |
| 3,076,205 | 2/1963 | Schults . | |
| 3,777,774 | 12/1973 | Martin | 137/234.6 |
| 4,901,748 | 2/1990 | Shotmeyer . | |
| 4,988,020 | 1/1991 | Webb . | |
| 4,989,634 | 2/1991 | Rieseck . | |
| 5,390,173 | 2/1995 | Fiech . | |
| 5,526,964 | 6/1996 | Moore et al. . | |
| 5,586,586 | 12/1996 | Fiech . | |
| 5,954,085 | 9/1999 | Moore et al. | 137/234.6 |

*Primary Examiner*—Kevin Lee
*Attorney, Agent, or Firm*—Feldman Gale & Weber, PA

[57] ABSTRACT

A prefabricated modular fuel dispensing system comprising a foundation, including a longitudinally extending tubular underground fuel tank, having a fuel storage compartment and a conduit containment trough along its upper surface, and a canopy supported above said tank when it is in place, the support being characterized by two sections, one connected to the tank side, and an upper section being attached to the canopy. The two sections are interconnected with horizontal impact relief structure arranged to fail when subjected to lateral impact of sufficient magnitude to otherwise bend the lower column portion or damage the tank.

13 Claims, 6 Drawing Sheets

FUEL DISPENSING SYSTEM

BACKGROUND OF THE DISCLOSURE

1. Field of the Invention

A prefabricated modular fuel dispensing system comprising a foundation, including a longitudinally extending tubular underground fuel tank, having a fuel storage compartment and a conduit containment trough along its upper surface, and a canopy supported above said tank when it is in place, the support being characterized by two sections, one connected to the tank side, and an upper section being attached to the canopy. The two sections are interconnected with horizontal impact relief structure arranged to fail when subjected to lateral impact of sufficient magnitude to otherwise bend the lower column portion or damage the tank.

2. Description of the Prior Art

Commonly, gasoline pumps are mounted on an island and connected to gasoline tanks located at a distance. This is inconvenient and requires elaborate piping arrangements which may be environmentally unfriendly. The invention of U.S. Pat. No. 5,526,964 of Moore and Sabatinelli, issued Jun. 18, 1996, describes an improved prefabricated modular fuel dispensing system which includes a foundation module, including an underground fuel tank, a fuel dispensing module, an overhead canopy, and means to support the canopy over the fuel dispensing module. The invention includes at least two canopy support columns secured to the underground reservoir and arranged to adjustably support the canopy above the tank and the dispensing system at opposed ends thereof.

Application Ser. No. 08/664,532, having the same inventors, filed Jun. 17, 1996, entitled "Prefabricated Modular Fuel Dispensing System" is likewise indicative of fuel dispensing systems in which the instant application can be an improvement.

Other prior art, cited in the specification of U.S. Pat. No. 5,526,964, is incorporated herein by reference. See also the U.S. patent to F. Larsen et al, U.S. Pat. No. 2,959,826, which generally discloses the combination of an underground tank, a canopy, and a canopy support structure at opposed ends of a storage island above the tank.

There has now been recognized the need for alternate means to interconnect the canopy to the underground fuel tank. In some instances, there is limited space within which to install the system, and it is desirable to have the canopy support structure on one side only of the canopy and tank. In alternate embodiments, the support structure is located substantially along the vertical center line of the canopy and tank, more centrally of the canopy and tank. These canopy mounting arrangements are useful to more efficiently utilize limited space and to allow more flexibility in the arrangement of dispensing modules. Centrally locating the support structure, or mounting it to one side of the tank, allows utilization of the invention with fuel dispensers which can be arranged either laterally or longitudinally of the dispensing system. The support structure of this invention, which allows the use of a single column supporting the canopy, either mounted on one side of the tank or substantially centrally thereof, includes structure arranged to absorb horizontal impact as may accidentally occur when a vehicle approaching the dispensing system collides with the support structure. The impact relief structure is arranged to fail when subjected to lateral impact of sufficient magnitude as may otherwise damage or move the fuel tank of the dispensing system. The structure is also arranged to provide relief in natural disasters such as hurricanes where winds, for example, of over 150 mph can be directed against the canopy.

SUMMARY OF THE INVENTION

The present invention relates to a prefabricated modular fuel dispensing system which has a foundation module which includes an underground fuel reservoir, or tank. There is an upwardly extending peripherally enclosed conduit containment trough attached along an upper surface of the tank. The conduit containment trough includes gasoline piping, tank fill vents, piping, risers, and the like, and includes overfill protection and secondary containment to comply with environmental protection regulations.

There is a fuel dispensing module including a pump island which operatively supports one or more fuel dispensing devices, coupled to the underground fuel tank through the conduit containment trough. There is a canopy module including an upper canopy support member, held in fixed spaced relationship above the fuel dispensing module and the tank, which upper canopy support member is carried by a lower canopy support stub member through impact relief structure. The impact relief structure is attached to the lower column stub, which is aligned with the upper canopy support member, the stub being in one embodiment mounted substantially centrally of a side of the fuel tank to one side of the conduit containment trough.

More particularly, the impact relief structure is comprised of a plurality of apertured flat metal plates, constructed and arranged to cooperate with each other to maintain the stub and upper column fasteners in tension when in use. There are additional fasteners arranged to shear under lateral impact when the upper column support is subjected to lateral force of sufficient magnitude to otherwise bend the stub, or damage the tank. The upper and lower column portions include plates with apertures arranged to align and cooperate with appropriate apertures formed in the group of plates which constitute the impact relief structure when assembled. There are actually different groups of apertures which serve different functions in use. Fasteners are arranged to pass through the aligned selected apertures in other plates. Some of the fasteners are arranged to shear when sufficient lateral impact, or force, is exerted against the upper column. Other fasteners cooperate with the uniquely shaped peripheries of the plates to allow relative lateral movement thereof when the first group of fasteners are sheared, without shearing or damaging the remaining fasteners. Further, there is means to allow adjustment of the relationship between the upper and lower column members, if that is needed, to level the canopy.

The invention accordingly comprises the features of construction, combination of elements, and arrangement of parts which will be exemplified in the construction hereinafter set forth, and the scope of the invention will be as indicated in the claims.

BRIEF DESCRIPTION OF THE DRAWINGS

For a fuller understanding of the nature and objectives of the invention, reference should be had to the following detailed description, taken in connection with the accompanying drawings in which.

DETAILED DESCRIPTION OF THE INVENTION

Figure 1:
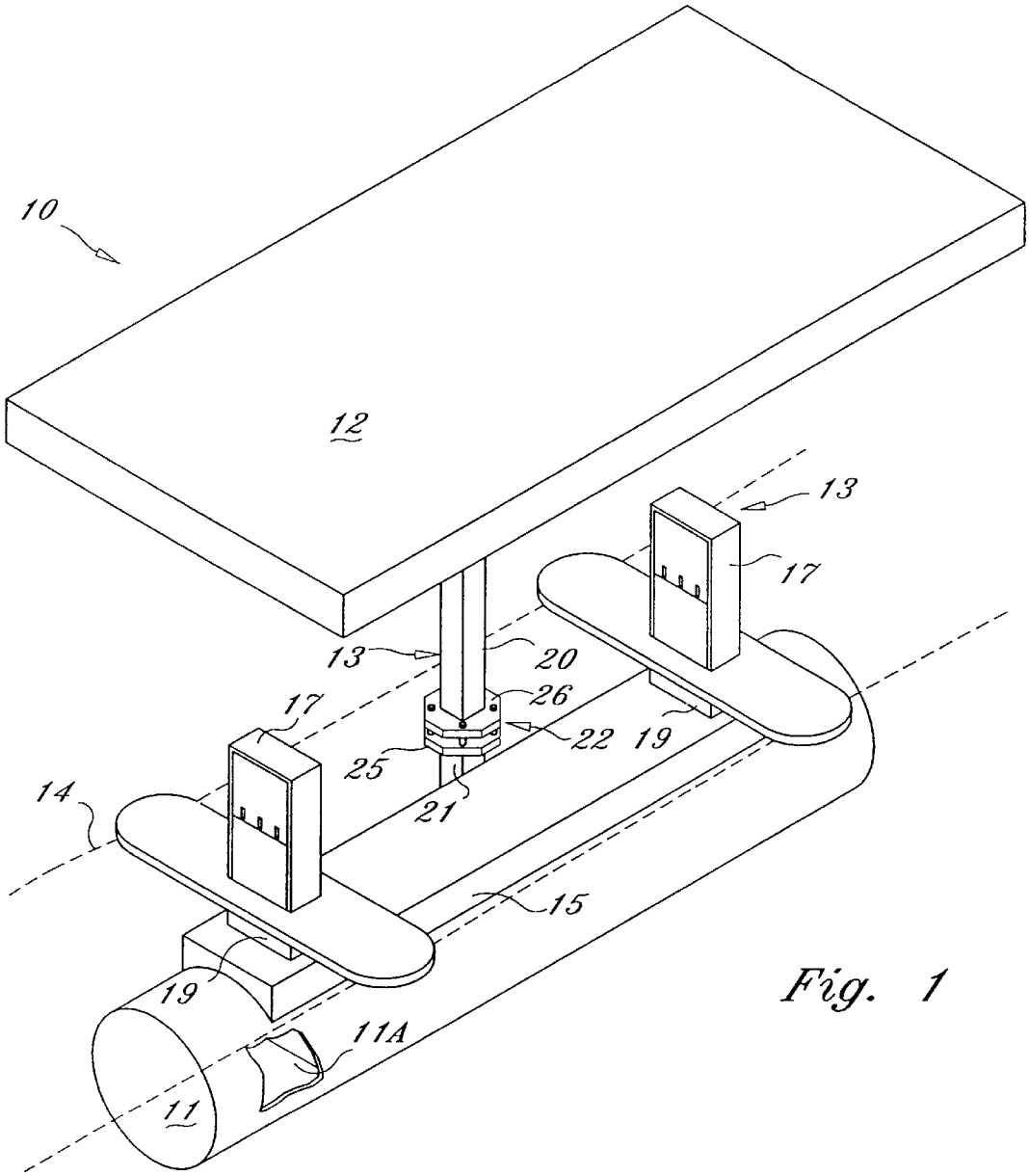
FIG. 1 is a perspective view of a fuel dispensing system according to the invention, with a single support column.

As best shown in FIG. 1, the present invention relates to a prefabricated modular fuel dispensing system generally indicated as 10, consisting of a fuel tank 11, having a canopy 12 supported thereabove by a support column generally indicated as 13. In use, the tank is buried below the ground, generally indicated by the dotted line 14.

Figure 14:
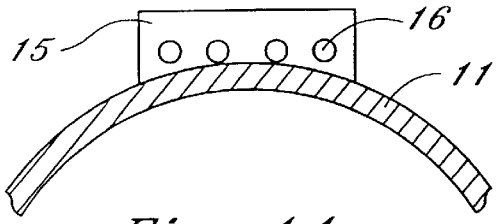
FIG. 14 is a cross-sectional view of a portion of a fuel containment trough found in fuel dispensing tanks utilizing the invention.

There is a fuel containment trough 15 extending upwardly from the top arcuate surface of the tank 11. The containment trough defines a space which is enclosed by peripheral walls and, in the preferred embodiment, the top of the tank, and extends substantially the entire length of the tank 11, and enclosed within it are a plurality of conduits (best shown in FIG. 14) arranged to carry fuel from the tank 11 to fuel dispensing apparatus 17. A more detailed description of the fuel containment trough and its cooperation with the conduits and the like will be found in U.S. Pat. No. 5,526,964 and application Ser. No. 08/664,532 above described, and the disclosure thereof are incorporated herein by reference.

There are usually a plurality of separate reservoirs in the tank 11, formed by one or more internal baffles, or walls 11A.

There is usually a raised pump island 18, formed about each of the fuel dispensers 17 with the upper surface thereof being just above ground level, schematically indicated by a dashed line 14. There is a hollow riser 19 through which pass piping connecting conduits 16 to the fuel dispenser nozzle of fuel dispenser 17.

The column consists of an upper portion 20 and a stub portion 21, interconnected by impact relief structure 22.

The impact relief structure consists of a plurality of plate members and fasteners. There is a stub column plate 25 attached to the top of stub structure 21, a canopy upper column base plate 26 attached to the bottom of column 24, a leveling plate 27, and a plurality (8) of plate washer 35, one on each opposing side of each fastener 34A in the structure, as best shown in FIGS. 3 and 9.

Figure 5:
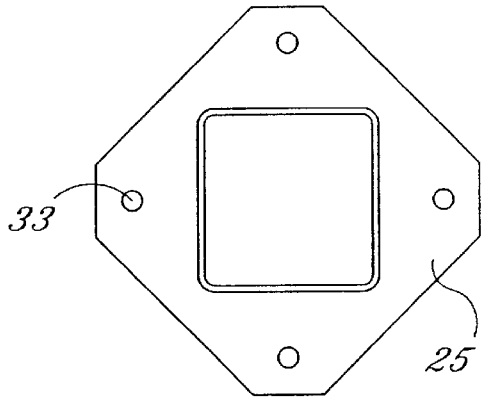
FIG. 5 is a top view of the upper stub column plate which forms a part of the impact relief arrangement of FIG. 3.
Figure 6:
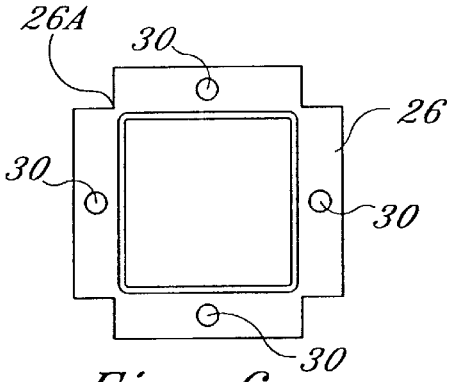
FIG. 6 is a top view of the canopy column base plate which forms a part of the arrangement of FIG. 3.
Figure 7:
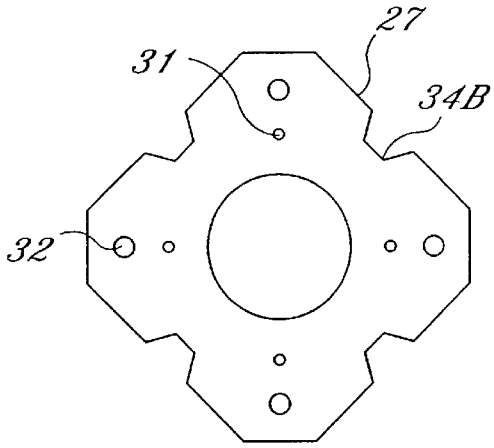
FIG. 7 is a top view of the leveling plate which forms a part of the impact relief arrangement of FIG. 3.
Figure 9:
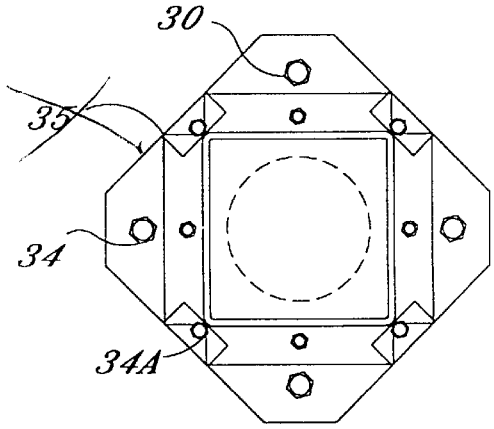
FIG. 9 is a top view of the assembly of plates of FIG. 3.
Figure 10:
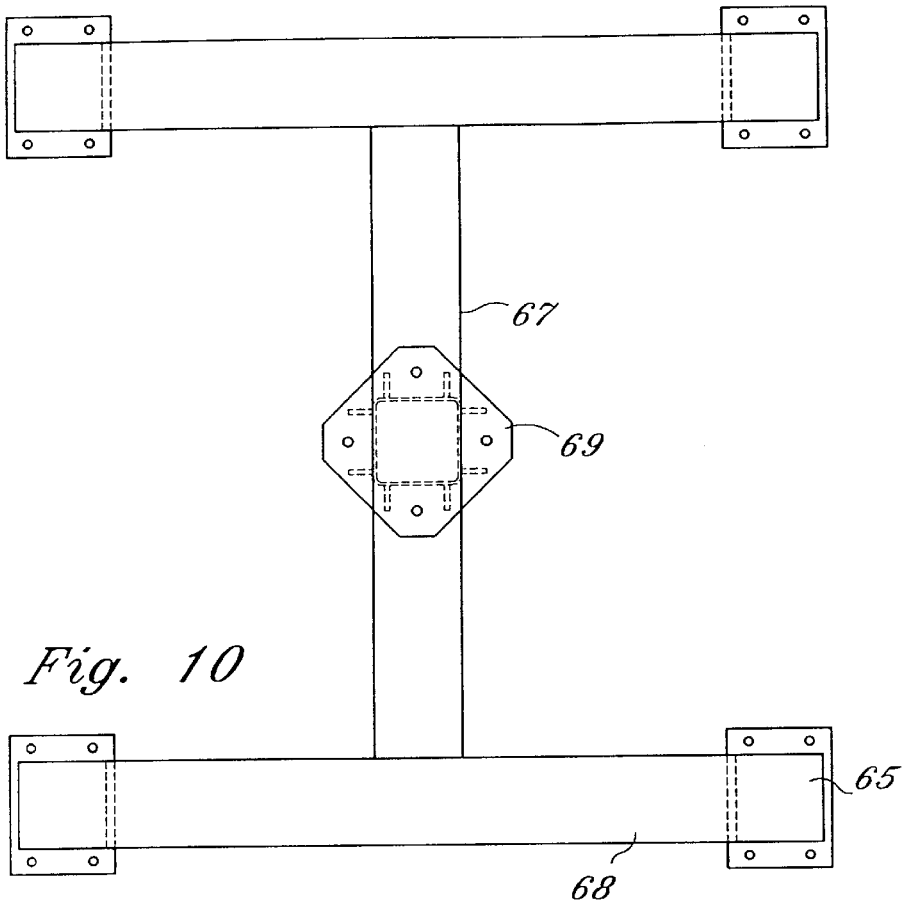
FIG. 10 is a top view of an alternate base support structure utilizing an impact relief system according to the invention, arranged to utilize a single, substantially centrally located column to support the canopy.
Figure 15:
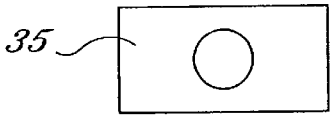
FIG. 15 is a plate washer used in the tank stub support system.
Figure 11:
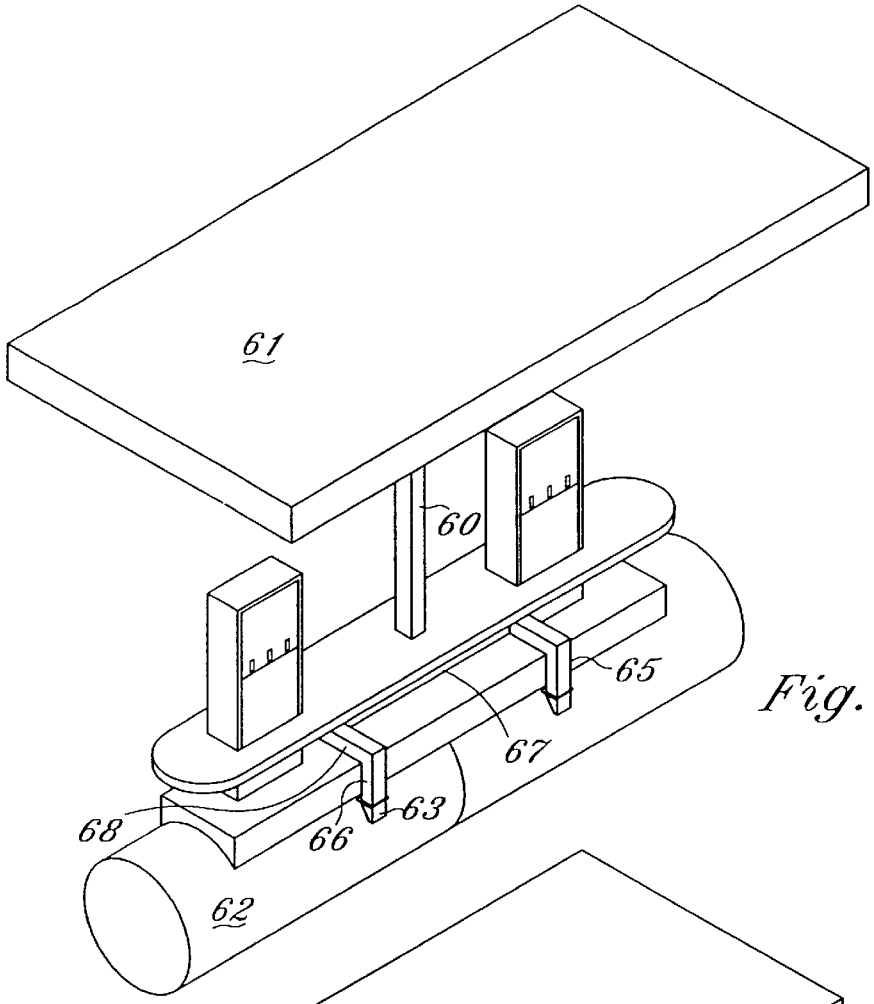
FIG. 11 is a perspective view of an alternative dispensing system according to the invention, using the support structure of FIG. 10.

In FIG. 9, the plates of FIGS. 5, 6, and 7 are viewed from above as they are arranged when assembled. The orientation of the plates in FIG. 9 corresponds to the relative orientation actually shown of the various plates in FIGS. 5, 6, and 7. Looking for the moment at FIG. 6, each of the apertures 30 in the preferred embodiment are 11/16 inch in diameter arranged to receive ⅝ inch by 3½ inch long A307 shear bolts. Leveling plate 27 (FIG. 7) has four apertures, or holes 31 which align with the holes 30. The holes 32 in shear plate 27 are 1⅛ inch arranged to take 1 inch by 10 inch A325 connection bolts. Holes 32 are arranged to align with holes 33 to receive four 1 inch by 10 inch A325 connection bolts 34. There are eight plate washers 35 (see FIG. 15 for detail), one for each side of each of the A325 bolts 34A. The bolts 34A are positioned within the notches 34B of the leveling plate 27 to allow lateral sliding movement of the leveling plate and canopy column base plate 26 when lateral impact of sufficient magnitude is applied against the upper column support 20. The corner notches 26A in the column base plate 26 align with the notches 34B in the leveling plate, thus allowing the upper column and its base plate to move and shear the fasteners in the apertures 30 of plate 26 and apertures 31 of the leveling plate 27, when subjected to sufficient lateral impact force.

Figure 3:
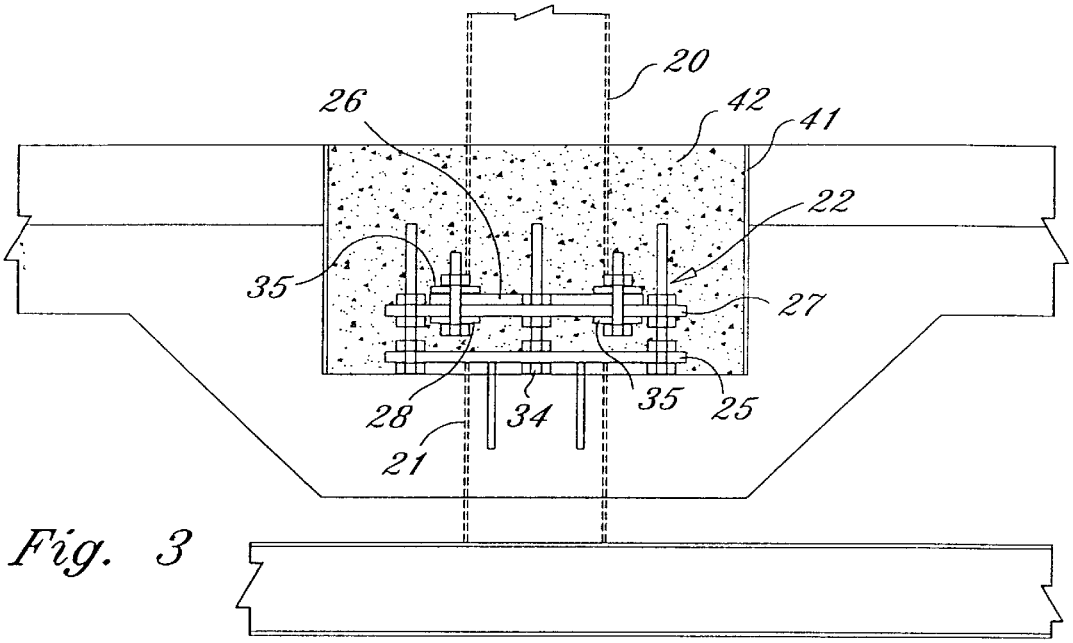
FIG. 3 is an enlarged side elevation of the plates which together form impact relief connection according to this invention.

Looking for the moment at FIG. 3, there are sets of additional nuts 40 on bolts 34. By appropriate loosening and tightening of the nuts 40 on the threaded shaft of the bolts, the leveling plate 27 can be raised and lowered suitably to adjust the level of the canopy.

After assembly of the fuel dispensing system, burying of the tank, and putting the canopy column assembly in place, the area within Sonatube cylinder 41 is filled with grouting. Preferably, the grout 42 is of a sand and cement mixture having substantially no structural strength, thus being easily crushable when impact force is applied to column 20, and plates 26 and 27 must move relative to each other to shear the bolts. In FIG. 3, all parts are approximately to scale and the Sonatube 41 is of 30 inch material.

Figure 2:
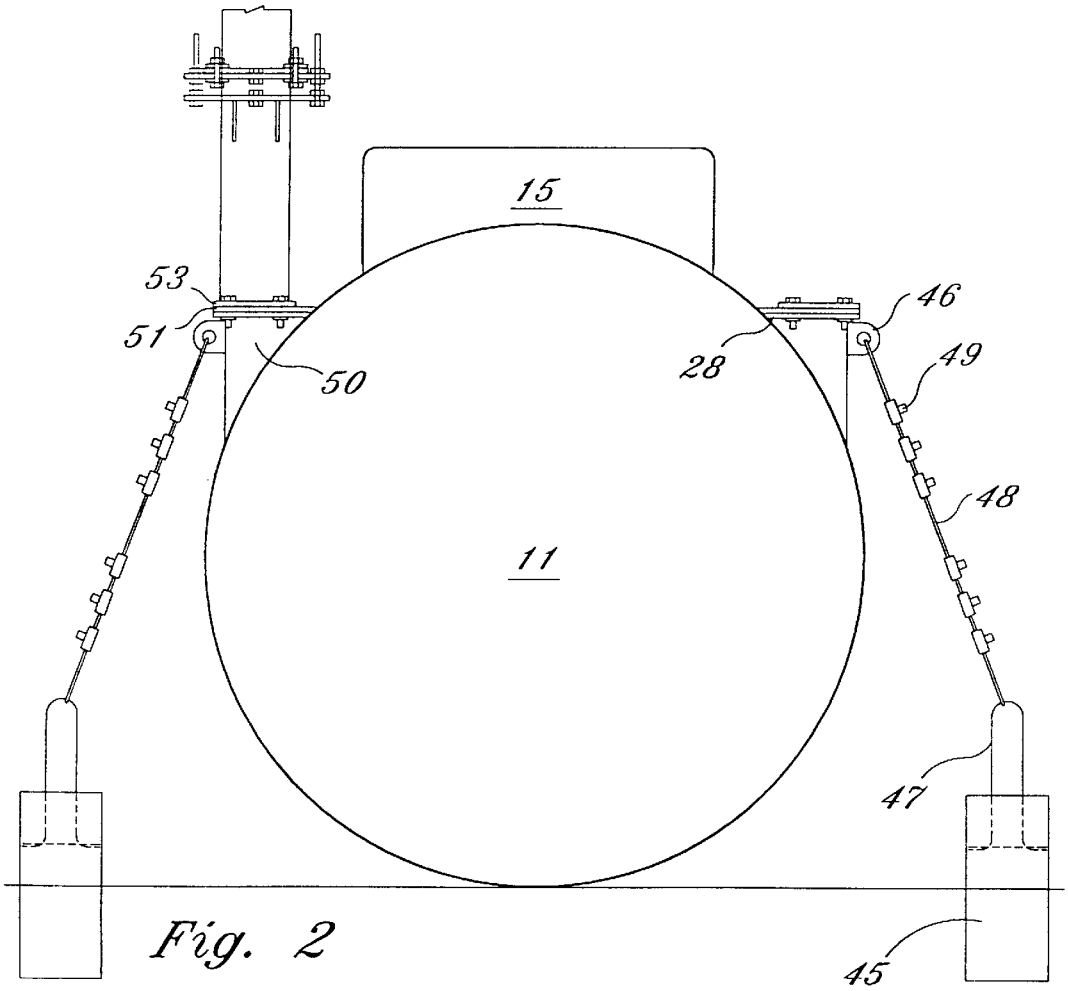
FIG. 2 is a side elevation of a portion of the system of FIG. 1.

Referring for the moment to FIG. 2, when the tank 11 is placed in a suitable excavation below ground level 14, dead man anchors 45 are installed. They can be of preformed concrete, or concrete poured in place. The dead man anchor is connected to lugs 46 and bails 47 along the dead man anchors by steel cable 48, which can be fastened in place by cable clamps 49. The cable clamps are adjusted to hold the top of the containment trough in a plane substantially parallel to the canopy when it is installed.

The dead man anchor bolts and lugs are of a sufficient size to maintain the tank in the desired position. With an eight foot tank diameter, the dead man anchor can be, for example, 12×12× an appropriate number of linear feet of preformed or poured concrete including suitable reinforcing bars. The bails 47 can be made from a bent number 3 reinforcing bar, for example. The cable can be ½ inch steel cable. The cable clamps can be ½ inch to take the ½ inch cable.

Figure 8:
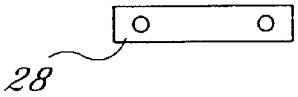
FIG. 8 is a top view of a column washer plate which forms a part of the system for attaching the stub column to the side of the fuel tank of FIG. 3.

There are suitable flange support structures 50 welded to the side of the tank below the fuel containment trough 15, at a position which will allow a lower column stub 21 to pass to one side of the containment trough. We have shown a column on one side of the trough, however, there is often two columns one on each side of the trough. The flange support structure includes a plate 51 below which are a pair of washer plates 28 (of FIG. 8), there being one on each side of the support and having spaced apertures aligned with those of tank support plate 51 and holes or apertures 53A in stub base plate 53. The holes can be on the order of 1 inch for connection by four ¾×3½ inch A325 bolts.

Figure 2A:
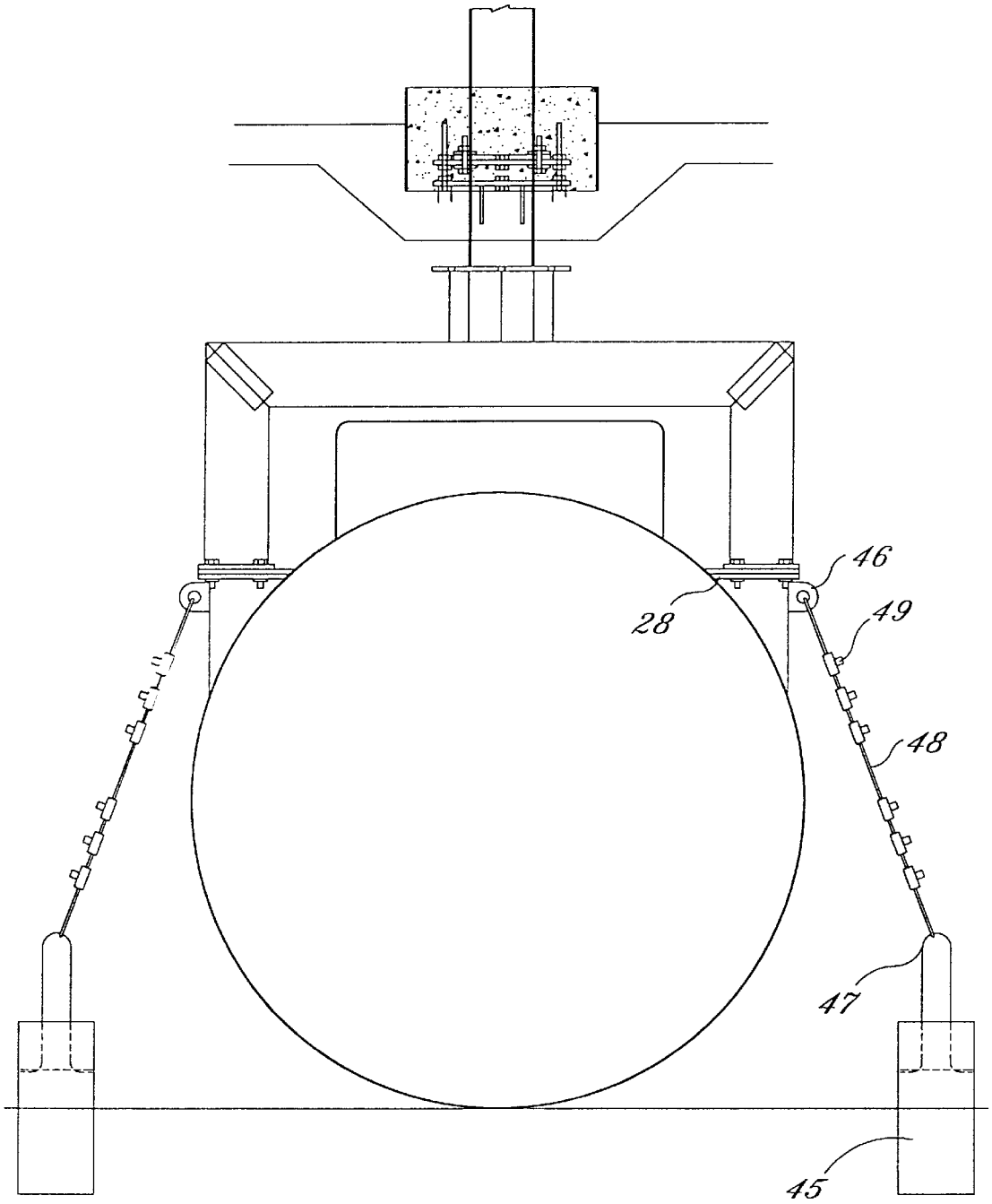
FIG. 2A is a side elevation of a column support system which is an alternate to that shown in FIG. 2.
Figure 4:
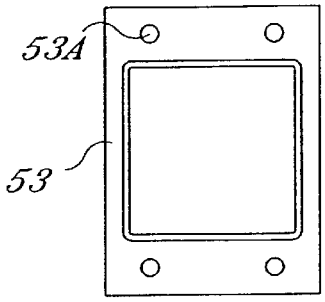
FIG. 4 is a top view of the base plate for the lower or stub portion of the support column.
Figure 12:
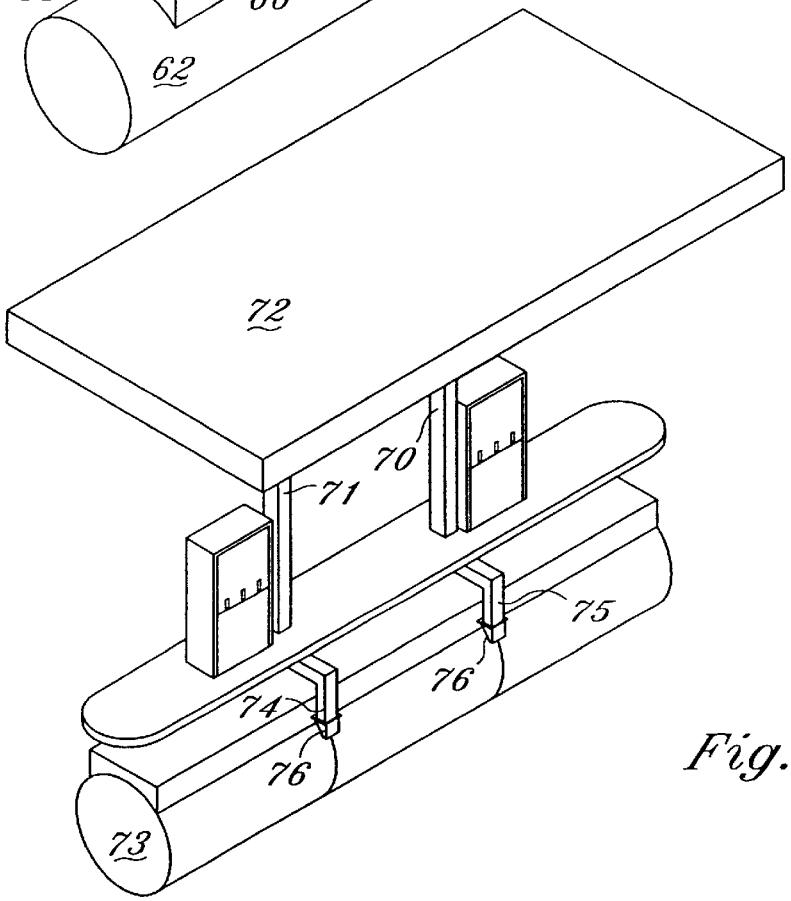
FIG. 12 is a perspective view of an alternate dispensing system according to the invention, utilizing the column support structure of FIG. 14.

In FIG. 12, there is shown an alternate prefabricated fuel dispensing structure according to this invention, in which there is a central column 60 supporting a canopy 61 above the tank 62. There are four support structures 63 mounted in opposed pairs on opposite sides of the tank, arranged to be connected to and carry stub arms 65 and 66 and mirror image pairs on the opposite side of the tank interconnected by arms 68 and central cross member 67. Just as in FIG. 2, there are lower plates on the arms 65 which mate with opposed plates on the supports 63. Substantially centrally of the cross member 67, there is fastened a plate 69 having dimensions the same as plate 25 in FIG. 5. The plate 69 functions in the same manner as the plate 25, and a group of additional plates best seen in FIG. 2A, but equivalent to plates 27 and 26 etc., i.e. the leveling plate and the upper column base plate, to form the impact absorbing structure above described.

In FIG. 12 there is shown yet another alternative embodiment of the invention in which there are two column structures 70 and 71 which support a canopy 72 above the tank 73. There are spaced yokes or saddles 74 and 75 having opposed mirror image arms on opposite sides of the tank, supported on spaced supports 76 and 77, welded to the opposed sides of the tank in the same manner as the tank support 50 in FIG. 2.

Figure 13:
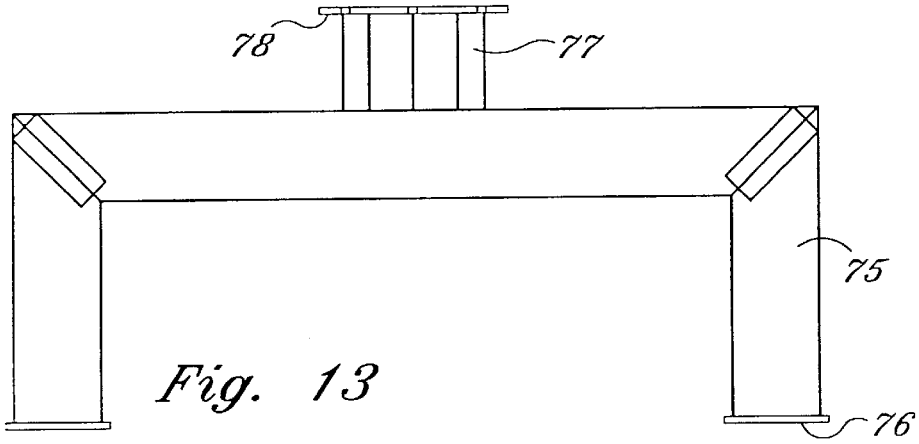
FIG. 13 is a side elevation of support structure for the system of FIG. 12.

Looking for the moment at FIG. 13, the yokes or saddles which support the upper column section 70 and 71 on the tank 73 are shown in more detail. Each of the saddle arms 75 end in a plate 76 to be supported on the opposed plate carried on the side of the tank. Substantially centrally of the saddle or yoke there is a column stub 77 which includes a stub column plate 78 comparable in all respects to the plate 25 of FIG. 5. In operation, the plate 78 is assembled with plates comparable to the leveling plate 27 and the upper column base plate 26 of FIG. 6 to form an impact relief assembly comparable to that of FIGS. 3 and 9. The plates are interconnected in a comparable manner and operate to provide impact relief in the same manner as the structure described above in relation to the preferred embodiment of FIG. 1.

In a preferred embodiment, the tank construction is double wall steel, composed of a steel primary tank encapsulated by a steel secondary tank, or a jacketed steel tank composed of a steel primary wall encapsulated by a fiberglass secondary shell, all of which is known and recognized in the art of fuel tank constructions. There can be one or more internal bulkheads to create separate volumetric storage areas within the primary tank, allowing for storage of separate fuel products. All product piping and related connections are steel and contained within a peripherally enclosing containment trough which is seal welded. The entire tank and trough is protected by corrosion resistant material, preferably a Glasteel fiberglass laminate system which meets all of the criteria set forth in Underwriters's Laboratory UL-1746 Standard Part II. The column support connections are preferably constructed of ASTM A36 carbon steel.

All of the steel plates in the sandwich of plates used in the impact relief structure are drawn substantially to scale in the drawings. The columns are preferably 10×10×¼ inch hollow columns. The plates are preferably ½ inch thick.

The impact relief structure has been designed to withstand tension forces of a magnitude which may be encountered with 150 mph winds. The shearable bolts have been designed to withstand a lateral impact force of 16,000 pounds. The impact relief structure and one or more columns can be to the side of the longitudinal axis of the tank or to a side of the lateral centerline of the tank.

It can thus be seen by the above detailed description, there is provided a prefabricated modular fuel dispensing system which includes a longitudinally extending tubular underground fuel tank which can be divided into multiple fuel storage compartments and arranged to store a variety of fuels. The fuels are dispensed through appropriate piping contained in a longitudinally extending peripherally enclosed conduit containment trough which is attached along an upper surface of the tank. There are fuel dispensing modules supported above the containment trough arranged to receive fuel at multiple dispensing stations. There is a canopy which is held in spaced relationship above the tank by canopy support means which are ultimately carried by the underground storage tank.

According to this invention, the canopy support consists of lower column support structure interconnected to upper column structure through impact relief structure constructed and arranged to secure in tension the lower or stub portion of the column to the upper portion of the column in use, but designed to fail when subjected to lateral impact forces of a sufficient magnitude to otherwise bend the stub or damage the tank. The structure is comprised of a group of cooperating plates interconnected in such a manner as to allow lateral movement in shearing of fastener members, thereby effectively partially disconnecting the upper column structure and canopy before any damage is done to the lower or stub portion or to the tank.

Having thus described the invention in detail, what is claimed is:

1. In a prefabricated modular fuel dispensing system comprising a foundation including a longitudinally extending tubular underground fuel tank, having at least one fuel storage compartment to store fuel to be dispensed, and an upwardly extending peripherally enclosed conduit containment trough attached along an upper surface area of said tank, said system further including a fuel dispensing module above said containment trough, and a canopy member held in spaced relationship above said fuel dispensing tank by canopy support means carried by said underground fuel tank, the improvement comprising said canopy support means extending upwardly from at least one longitudinal side of said fuel tank intermediate its ends, said canopy support means comprising upper and lower column support sections, a lower column stub section fixed to an outer surface of said tank below and to the side of said containment trough in a position selected to support and balance in position the upper column support section and said canopy member over said tank when said tank is installed, there being horizontal impact relief means operatively connecting the column stub section to the upper column support section, said impact relief means including fastener means constructed and arranged to secure in tension the stub section to the upper column support section in normal use but fail when subjected to lateral impact of sufficient magnitude to bend said stub or damage said tank.

2. In a prefabricated modular fuel dispensing system comprising a foundation including a longitudinally extending tubular underground fuel tank having at least one fuel storage compartment to store fuel to be dispensed, and an upwardly extending peripherally enclosed conduit containment trough attached along the upper surface of said tank, and a canopy member held in spaced relationship to said fuel dispensing tank by canopy support means carried by said underground fuel tank, the improvement comprising said canopy support means consisting of a lower column stub fixed to an outer surface of said tank below and to the side of said containment trough in a position selected to support and balance an upper column support for said canopy member when said tank is installed underground, there being horizontal impact relief means operatively connecting the column stub to the upper column, said impact relief means constructed and arranged to secure in tension the stub to the upper column in normal use but fail when subjected to lateral impact of sufficient magnitude to bend said stub or damage said tank.

3. The fuel dispensing system of claim 2 in which said tank is of circular cross-section.

4. The fuel dispensing system of claim 3 in which the canopy support means is off center relative to the center line of the tank.

5. The system of claim 4 in which the centerline is longitudinal to the central axis of the tank.

6. The system of claim 4 in which the centerline is lateral to the axis of the tank.

7. The system of claim 4 in which the canopy support means is connected to a single side of the tank.

8. The system of claim 4 in which the upper column support means comprises a structure having downwardly extending opposed arms arranged to be supported by column stubs mounted on opposite sides of the tank.

9. The system of claim 8 in which said upper column support means includes a generally H shaped connecting structure which includes four downwardly extending legs arranged to be supported on two pairs of opposed lower column stubs, said connecting structure including an upwardly extending central arm arranged to support the remainder of the upper column and said canopy member substantially central to said H shaped connecting structure.

10. In the prefabricated modular fuel dispensing system of claim 2 said impact relief means includes a series of three parallel plates, there being apertures in said parallel plates which are aligned to receive adjustable fasteners, the fasteners cooperating with mating plate apertures to fix said plates in operative position when the system is installed.

11. The system of claim 10 in which at least some of the fasteners are adjustable to level said canopy member when needed.

12. The system of claim 10 in which the plates are constructed and arranged to allow at least some lateral movement between said plates of the fasteners to shear when the upper column support is subjected to a sufficient magnitude of lateral impact to otherwise bend the stub or damage or move the tank.

13. In a prefabricated modular fuel dispensing system comprising a foundation including a longitudinally extending tubular underground fuel tank having at least one fuel storage compartment to store fuel to be dispensed, and a canopy member held in spaced relationship to said fuel dispensing tank by canopy support means carried by said underground fuel tank, the improvement comprising said canopy support means consisting of a lower column stub fixed to an outer surface of said tank below and to the side thereof in a position selected to support and balance an upper column support for said canopy member when said tank is installed underground, there being horizontal impact relief means operatively connecting the column stub to the upper column, said impact relief means constructed and arranged to secure in tension the stub to the upper column in normal use but fail when subjected to lateral impact of sufficient magnitude to otherwise bend said stub or damage said tank.

* * * * *